US006900766B2

(12) United States Patent
Komatsu et al.

(10) Patent No.: US 6,900,766 B2
(45) Date of Patent: May 31, 2005

(54) VEHICLE ANTENNA

(75) Inventors: Satoru Komatsu, Tokyo (JP); Hiroshi Kuribayashi, Higashimatsuyama (JP); Tomoyuki Fukumaru, Kawachi-gun (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 10/734,580

(22) Filed: Dec. 15, 2003

(65) Prior Publication Data

US 2004/0174304 A1 Sep. 9, 2004

(30) Foreign Application Priority Data

Dec. 27, 2002 (JP) ..... 2002-379997

(51) Int. Cl.[7] ..... H01Q 1/32

(52) U.S. Cl. ..... 343/700 MS; 343/711; 343/713

(58) Field of Search ..... 343/700 MS, 711, 343/713, 767–769, 846, 866

(56) References Cited

U.S. PATENT DOCUMENTS 5,952,971 A * 9/1999 Strickland ..... 343/700 MS
6,097,345 A * 8/2000 Walton ..... 343/711
6,329,950 B1 * 12/2001 Harrell et al. ..... 343/713
6,597,316 B2 * 7/2003 Rao et al. ..... 343/700 MS

FOREIGN PATENT DOCUMENTS

| | | |
|---|---|---|
| JP | 02-230804 | 9/1990 |
| JP | 05-160633 | 6/1993 |
| JP | 05-167337 | 7/1993 |
| JP | 05-243836 | 9/1993 |
| JP | 2884885 | 2/1999 |
| JP | 2002-252520 | 9/2002 |

* cited by examiner

*Primary Examiner*—Don Wong
*Assistant Examiner*—Ephrem Alemu
(74) *Attorney, Agent, or Firm*—Arent Fox PLLC

(57) ABSTRACT

A vehicle antenna including a dielectric substrate having a surface, a first radiator disposed on the surface of the dielectric substrate and having an aperture therein at which the surface is partially exposed, a first ground conductor disposed on the surface of the dielectric substrate and surrounding the first radiator while providing a substantially loop-shaped space between the first radiator and the first ground conductor, a second radiator disposed on the surface of the dielectric substrate and in the aperture of the first radiator, and a second ground conductor disposed on the surface of the dielectric substrate and surrounding the second radiator while providing another substantially loop-shaped space between the second radiator and the second ground conductor.

5 Claims, 1 Drawing Sheet

VEHICLE ANTENNA

BACKGROUND OF THE INVENTION

1. Field of the Invention

The present invention relates to a vehicle antenna.

Priority is claimed on Japanese Patent Application No. 2002-379997, filed Dec. 27, 2002, the content of which is incorporated herein by reference.

2. Description of Related Art

A patch antenna, which includes a radiation conductor provided on an inner surface of a vehicle glass and a ground conductor which is provided on the same surface as the radiation conductor and which is formed in a substantially loop-shape surrounding the radiation conductor while having a space therebetween, is known from, for example, Japanese Unexamined Patent Application, First Publication No. 2002-252520.

When the above conventional patch antenna is provided on a vehicle, and more specifically, the patch antenna is disposed on a glass of the vehicle such as a front glass thereof or rear glass thereof, it is desirable that blocking of the field of view of the vehicle occupants be avoided, and that degrading of the external appearance of the vehicle be avoided.

In addition, when, for example, plural patch antennas for covering frequency bands that differ from each other are disposed on a glass of a vehicle, it is desirable that the area occupied by the patch antennas be reduced while also ensuring desired transmitting and receiving performances of the patch antennas.

SUMMARY OF THE INVENTION

In view of the above circumstances, an object of the present invention is to provide a vehicle antenna which allows reduction of the area in which plural patch antennas are arranged while also ensuring desired transmitting and receiving performances of the patch antennas.

In order to achieve the above object, the present invention provides a vehicle antenna including: a dielectric substrate having a surface; a first radiator disposed on the surface of the dielectric substrate and having an aperture therein at which the surface is partially exposed; a first ground conductor disposed on the surface of the dielectric substrate and surrounding the first radiator while providing a substantially loop-shaped space between the first radiator and the first ground conductor; a second radiator disposed on the surface of the dielectric substrate and in the aperture of the first radiator; and a second ground conductor disposed on the surface of the dielectric substrate and surrounding the second radiator while providing another substantially loop-shaped space between the second radiator and the second ground conductor.

According to the vehicle antenna configured as described above, by providing the aperture in the first radiator that is surrounded by the first ground conductor, the resonance frequency can be decreased while ensuring a desired sensitivity when compared with a radiator that does not have an aperture therein. As a result, when the first radiator is made so as to ensure a desired resonance frequency, the first radiator can be made smaller than a radiator that does not have an aperture therein, i.e., the area on the surface of the dielectric substrate occupied by the first radiator can be reduced.

Moreover, by disposing a second patch antenna, which includes the second ground conductor and the second radiator, and which covers a frequency band that is higher than that in the case of a first patch antenna including the first ground conductor and the first radiator, in the aperture of the first radiator, the area occupied by the different patch antennas can be reduced.

In addition, by providing a single amplifying circuit for the patch antennas, the vehicle antenna can be made small, and manufacturing cost thereof can be reduced.

In the above vehicle antenna, the dielectric substrate may be a glass of a vehicle.

In the above vehicle antenna, the first radiator and the first ground conductor may together form a first patch antenna, and the second radiator and the second ground conductor may together form a second patch antenna. A second resonance frequency of a radio wave which is handled by the second patch antenna may preferably be set to be greater than a first resonance frequency of a radio wave which is handled by the first patch antenna. Moreover, the second resonance frequency may preferably be set so as not to be a multiple of the first resonance frequency.

In the above vehicle antenna, a common amplifying circuit may be provided for the first and second patch antennas.

DETAILED DESCRIPTION OF THE INVENTION

An embodiment of a vehicle antenna according to the present invention will be explained below with reference to the appended drawings.

Figure 1:
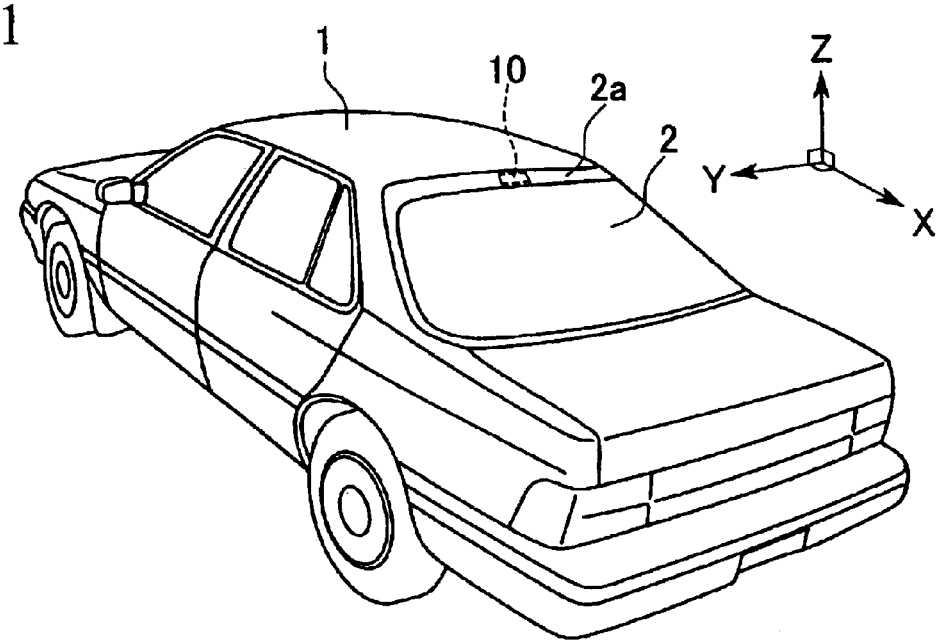
FIG. 1 is a perspective view showing a vehicle on which an embodiment of a vehicle antenna according to the present invention is installed.
Figure 2:
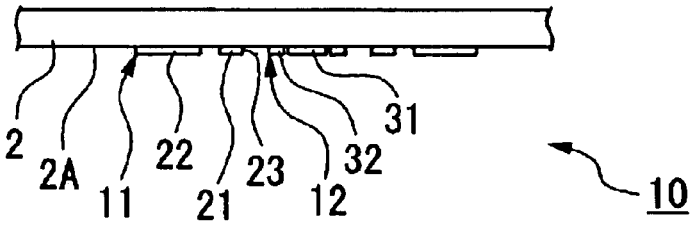
FIG. 2 is a cross-section of the vehicle antenna shown in FIG. 1.

As shown in FIGS. 1 and 2, a vehicle antenna 10 according to the present embodiment is disposed on an inner surface 2A of a rear glass 2 included in glasses of a vehicle 1, and is located in the periphery 2*a* of the rear glass 2.

The vehicle antenna 10 is provided as, for example, a GPS (Global Positioning System) antenna for receiving position signals from the GPS communication network in which positions of vehicles are measured using artificial satellites, or for enabling emergency communication that utilizes position information provided by GPS, a DSRC (Dedicated Short Range Communications) antenna for receiving data provided by various information supplying systems using DSRC between roadside radio devices and an onboard device, or for enabling operations of automatic toll systems, an antenna for receiving data provided by broadcast or various information supplying systems via artificial satellites, a mobile communication antenna for enabling mobile communications between artificial satellites and base stations, etc.

Figure 3:
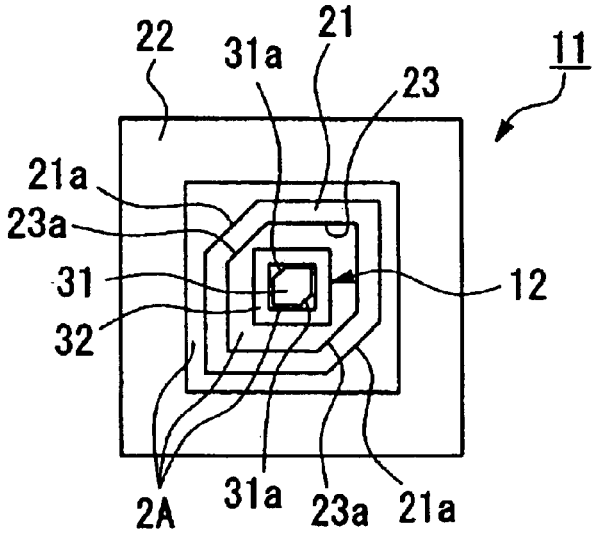
FIG. 3 is a plan view showing the vehicle antenna shown in FIG. 1.

The vehicle antenna 10 includes the rear glass 2 as a dielectric substrate and plural patch antennas (e.g., two patch antennas) disposed on the inner surface 2A of the rear glass 2. The plural patch antennas include a first patch antenna 11 and a second patch antenna 12 that is disposed inside the first patch antenna 11. As shown in FIG. 3, the first patch antenna 11 includes a first radiation conductor 21 including, for example, a conductive film that is disposed on the inner surface 2A of the rear glass 2, and a first ground conductor 22. The second patch antenna 12 includes a second radiation conductor 31 including, for example, a conductive film that is disposed on the inner surface 2A of the rear glass 2, and a second ground conductor 32.

The first radiation conductor 21 of the first patch antenna 11 includes a pair of opposed and substantially straight first perturbation segments 21*a* which are formed by cutting a pair of opposed comers, among two pairs of opposed comers, each corner being formed by adjacent sides intersecting at a substantially right angle, of a substantially quadrangular conductive film having two pairs of opposed sides. By providing the first perturbation segments 21*a*, it is possible to handle a circularly polarized mode.

Moreover, there is provided an aperture 23, i.e., a through hole, inside the first radiation conductor 21. In other words, the first radiation conductor 21 is formed in a substantially loop-shape, e.g., the first radiation conductor 21 is formed with a conductive strip having a predetermined width whose ends are connected to each other.

The inner periphery of the first radiation conductor 21 runs substantially parallel to the outer periphery thereof while providing a predetermined width to the first radiation conductor 21.

Accordingly, the inner periphery of the first radiation conductor 21 includes a pair of opposed and straight portions 23*a* corresponding to the pair of substantially straight first perturbation segments 21*a* in the outer periphery of the first radiation conductor 21.

The first radiation conductor 21 is connected to an appropriate feeder (not shown) so as to be supplied with appropriate high frequency current.

The first ground conductor 22 includes a conductive film formed in a substantially quadrangular loop-shape, and is continuously grounded by being connected to an appropriate ground line (not shown). The first ground conductor 22 surrounds the outer periphery of the first radiation conductor 21, which is disposed on the inner surface 2A, while providing a substantially loop-shaped space between the first radiation conductor 21 and the first ground conductor 22.

Accordingly, a portion of the inner surface 2A of the rear glass 2 acting as a dielectric substrate, which is located between the outer periphery of the first radiation conductor 21 and the inner periphery of the first ground conductor 22, is exposed. The first patch antenna 11 acts as an antenna by having a resonance circuit which is formed by the first radiation conductor 21 and the first ground conductor 22.

The dielectric constant of the rear glass 2 acting as a dielectric substrate, the lengths of the two pairs of opposed sides of the first radiation conductor 21, the distance between the outer periphery of the first radiation conductor 21 and the inner periphery of the first ground conductor 22, etc., are appropriately set so as to provide desired characteristics of antenna, such as a resonance frequency and frequency band of radio wave to be handled, to the first patch antenna 11.

The lengths of the two pairs of opposed sides of the first radiation conductor 21, which are determined for obtaining a desired resonance frequency, are generally less than those in the case in which the aperture 23 is not formed.

In other words, by providing the aperture 23 inside the first radiation conductor 21, the resonance frequency can be made lower than that in the case in which the aperture 23 is not formed in a radiator having an external size which is equivalent to that of the first radiation conductor 21. A reduction in the resonance frequency due to forming of the aperture 23 can be compensated for by reducing the external size of the first radiation conductor 21 when compared with the external size of the first radiation conductor 21 which is determined so as to achieve a desired resonance frequency without incorporating the aperture 23.

The second patch antenna 12 is disposed inside the aperture 23 formed in the first radiation conductor 21 of the first patch antenna 11. The second radiation conductor 31 of the second patch antenna 12 includes a pair of opposed and substantially straight second perturbation segments 31*a* which are formed by cutting a pair of opposed corners, among two pairs of opposed corners, each corner being formed by adjacent sides intersecting at a substantially right angle, of a substantially quadrangular conductive film having two pairs of opposed sides. The pair of second perturbation segments 31*a* enable handling of a circularly polarized mode.

The second radiation conductor 31 is connected to an appropriate feeder (not shown) so as to be supplied with appropriate high frequency current.

The second ground conductor 32 includes a conductive film formed in a substantially quadrangular loop-shape, and is continuously grounded by being connected to an appropriate ground line (not shown). The second ground conductor 32 surrounds the outer periphery of the second radiation conductor 31, which is disposed on the inner surface 2A, while providing a substantially loop-shaped space between the second radiation conductor 31 and the second ground conductor 32. Accordingly, a portion of the inner surface 2A of the rear glass 2 acting as a dielectric substrate, which is located between the outer periphery of the second radiation conductor 31 and the inner periphery of the second ground conductor 32, is exposed.

Moreover, by disposing the second ground conductor 32 inside the aperture 23 formed in the first radiation conductor 21 of the first patch antenna 11, a portion of the inner surface 2A of the rear glass 2 acting as a dielectric substrate, which is located between the outer periphery of the second ground conductor 32 and the inner periphery of the first radiation conductor 21, is exposed.

The second patch antenna 12 acts as an antenna by having a resonance circuit which is formed by the second radiation conductor 31 and the second ground conductor 32.

A second resonance frequency of the radio wave (e.g., 5.8 GHz) which is handled by the second antenna 12 is set to be greater than a first resonance frequency of the radio wave (e.g., 1.75 GHz) which is handled by the first antenna 11, and in addition, the second resonance frequency is set so as not to be a multiple of the first resonance frequency.

A single amplifying circuit, i.e., a common amplifying circuit, is provided for the first and second patch antennas 11 and 12.

As described above, according to the embodiment of the vehicle antenna 10, by forming the aperture 23 in the first radiation conductor 21, the area on the surface of the dielectric substrate occupied by the first radiation conductor 21 can be reduced when compared with the case in which the aperture is not formed.

Moreover, by disposing the second patch antenna 12, i.e., the second ground conductor 32 and the second radiation conductor 31 which together handle a frequency band that differs from that in the case of the first patch antenna 11, in the aperture 23 formed in the first radiation conductor 21, the area occupied by the different patch antennas 11 and 12 can be reduced.

Furthermore, by providing a single amplifying circuit for the patch antennas 11 and 12, the vehicle antenna 10 can be made small, and manufacturing cost thereof can be reduced.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

For example, in the above embodiment, the second patch antenna 12 is disposed in the aperture 23 formed in the first radiation conductor 21 of the first patch antenna 11; however, the present invention is not limited to this, and plural different patch antennas mat be disposed in the aperture 23 formed in the first radiation conductor 21 of the first patch antenna 11.

Moreover, another aperture may be formed inside the second radiation conductor 31 of the second patch antenna 12, and another patch antenna may be disposed in this aperture.

In the above embodiment, the patch antennas 11 and 12 include the radiation conductors 21 and 31 of conductive films and ground conductors 22 and 32 of conductive films, respectively; however, the present invention is not limited to this, and other radiators, such as those employing semiconductors may be used instead of the radiation conductors 21 and 31.

Advantageous Effects Obtainable by the Invention

As explained above, according to the vehicle antenna of the present invention, by forming the aperture in the first radiation conductor, the area on the surface of the dielectric substrate which is occupied by the first radiation conductor can be reduced when compared with the case in which the aperture is not formed.

Moreover, by disposing the second ground conductor and the second radiation conductor, which together handle a frequency band that differs from that in the case of the first patch antenna, in the aperture formed in the first radiation conductor, the area occupied by the different patch antennas can be reduced.

Furthermore, by providing a single amplifying circuit for the patch antennas, the vehicle antenna can be made small, and manufacturing cost thereof can be reduced.

What is claimed is:

1. A vehicle antenna comprising:

a dielectric substrate having a surface;

a first radiator disposed on the surface of the dielectric substrate and having an aperture therein at which the surface is partially exposed;

a first ground conductor disposed on the surface of the dielectric substrate and surrounding the first radiator while providing a substantially loop-shaped space between the first radiator and the first ground conductor;

a second radiator disposed on the surface of the dielectric substrate and in the aperture of the first radiator; and a second ground conductor disposed on the surface of the dielectric substrate and surrounding the second radiator while providing another substantially loop-shaped space between the second radiator and the second ground conductor.

2. A vehicle antenna according to claim 1, wherein the dielectric substrate is a glass of a vehicle.

3. A vehicle antenna according to claim 1, wherein the first radiator and the first ground conductor together form a first patch antenna, and the second radiator and the second ground conductor together form a second patch antenna, and wherein a second resonance frequency of a radio wave which is handled by the second patch antenna is set to be greater than a first resonance frequency of a radio wave which is handled by the first patch antenna.

4. A vehicle antenna according to claim 3, wherein the second resonance frequency is set so as not to be a multiple of the first resonance frequency.

5. A vehicle antenna according to claim 3, wherein a common amplifying circuit is provided for the first and second patch antennas.

* * * * *